US006382173B1

(12) United States Patent
Roe

(10) Patent No.: US 6,382,173 B1
(45) Date of Patent: May 7, 2002

(54) SPLIT BODY DEACTIVATION VALVE LIFTER

(75) Inventor: Richard Blanco Roe, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/563,145

(22) Filed: May 2, 2000

(51) Int. Cl.[7] ..... F01L 1/14
(52) U.S. Cl. ..... 123/198 F
(58) Field of Search ..... 123/198 F

(56) References Cited

U.S. PATENT DOCUMENTS 4,050,435 A * 9/1977 Fuller, Jr. et al. ..... 123/198 F
4,133,332 A * 1/1979 Benson et al. ..... 123/198 F
4,711,207 A * 12/1987 Bonvallet ..... 123/198 F
5,247,913 A * 9/1993 Manolis ..... 123/198 F
5,694,894 A * 12/1997 Allen ..... 123/198 F
6,076,491 A * 6/2000 Allen ..... 123/198 F
6,196,175 B1 * 3/2001 Church ..... 123/198 F

* cited by examiner

*Primary Examiner*—Marguerite McMahon
(74) *Attorney, Agent, or Firm*—John A. Vanophem

(57) ABSTRACT

A split-body deactivation valve lifter for use in an internal combustion engine includes a lower body having a substantially cylindrical base and an elongate column extending in an axial direction a predetermined distance above the base. The base is associated with a cam of the internal combustion engine and converts rotary motion of the cam to linear motion of the lower body. A substantially cylindrical upper body defines an axial column bore therein. A portion of the elongate column of the lower body is slidably disposed within the column bore. The upper body is associated with a valve of the internal combustion engine. The upper body is normally coupled to the elongate column of the lower body to thereby transfer vertical movement of the lower body to vertical movement of the upper body. The upper body is selectively decoupled from the lower body such that a lost motion spring prevents movement of one of the bodies from being transferred to movement of the other body.

27 Claims, 2 Drawing Sheets

SPLIT BODY DEACTIVATION VALVE LIFTER

TECHNICAL FIELD

The present invention relates to valve lifters for use with internal combustion engines, and, more particularly, to a valve lifter which accomplishes cylinder deactivation in internal combustion engines.

BACKGROUND OF THE INVENTION

Automobile emissions are said to be the greatest source of pollution in numerous cities across the country. Automobiles emit hydrocarbons, nitrogen oxides, carbon monoxide and carbon dioxide as a result of the combustion process. The Clean Air Act of 1970 and the 1990 Clean Air Act set national goals of clean and healthy air for all and established responsibilities for industry to reduce emissions from vehicles and other pollution sources. Standards set by the 1990 law limit automobile emissions to 0.25 grams per mile (gpm) non-methane hydrocarbons and 0.4 gpm nitrogen oxides. The standards are predicted to be further reduced by half in the year 2004. It is expected that automobiles will continue to be powered by internal combustion engines for decades to come. As the world population continues to grow, and standards of living continue to rise, there will be an even greater demand for automobiles. This demand is predicted to be especially great in developing countries. The increasing number of automobiles is likely to cause a proportionate increase in pollution. One major challenge facing automobile manufacturers is to reduce undesirable and harmful emissions by improving fuel economy, thereby assuring the increased number of automobiles has a minimal impact on the environment. A method by which automobile manufacturers have attempted to improve fuel economy and reduce undesirable emissions is cylinder deactivation.

Generally, cylinder deactivation is the deactivation of the intake and/or exhaust valves of a cylinder or cylinders during at least a portion of the combustion process. Cylinder deactivation is a proven method by which fuel economy can be improved. In effect, cylinder deactivation reduces the number of engine cylinders within which the combustion process is taking place. With fewer cylinders performing combustion, fuel efficiency is increased and the amount of pollutants emitted from the engine is reduced. For example, in an eight-cylinder engine under certain operating conditions four of the eight cylinders can be deactivated. Thus, combustion would be taking place in only four, rather than in all eight, cylinders. Cylinder deactivation is effective, for example, during part-load conditions when full engine power is not required for smooth and efficient engine operation. Studies have shown that cylinder deactivation can improve fuel economy by as much as fifteen percent.

Conventional methods of achieving cylinder deactivation have been accomplished through modification of various portions of the valve train, and have typically required the addition of components thereto. These conventional methods have typically not fit within the space occupied by conventional drive train components. Thus, the conventional methods of implementing cylinder deactivation have required modification and redesign of engines to provide the additional space within which to house components used to achieve cylinder deactivation.

Therefore, what is needed in the art is a lifter-based device which accomplishes cylinder deactivation.

Furthermore, what is needed in the art is a device which accomplishes cylinder deactivation and is designed to fit within existing space occupied by conventional drive train components.

SUMMARY OF THE INVENTION

The present invention provides a split-body deactivation valve lifter for use with an internal combustion engine.

The invention comprises, in one form thereof, a lower body having a substantially cylindrical base and an elongate column extending in an axial direction a predetermined distance above the base. The base is associated with a cam of the internal combustion engine and converts rotary motion of the cam to vertical motion of the lower body. A substantially cylindrical upper body defines an axial column bore therein. A portion of the elongate column of the lower body is slidably disposed within the column bore. The upper body is associated with a valve of the internal combustion engine. The upper body is normally coupled to the elongate column of the lower body to thereby transfer vertical movement of the lower body to vertical movement of the upper body. The upper body is selectively decoupled from the lower body such that vertical movement of the lower body is not transferred to vertical movement of the upper body.

An advantage of the present invention is that it is received within standard-sized engine bores which accommodate conventional valve lifters.

Another advantage of the present invention is that the deactivation pin assembly includes two pin members, thereby increasing the rigidity, strength, and operating range of the deactivation valve lifter.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENT

Figure 1:
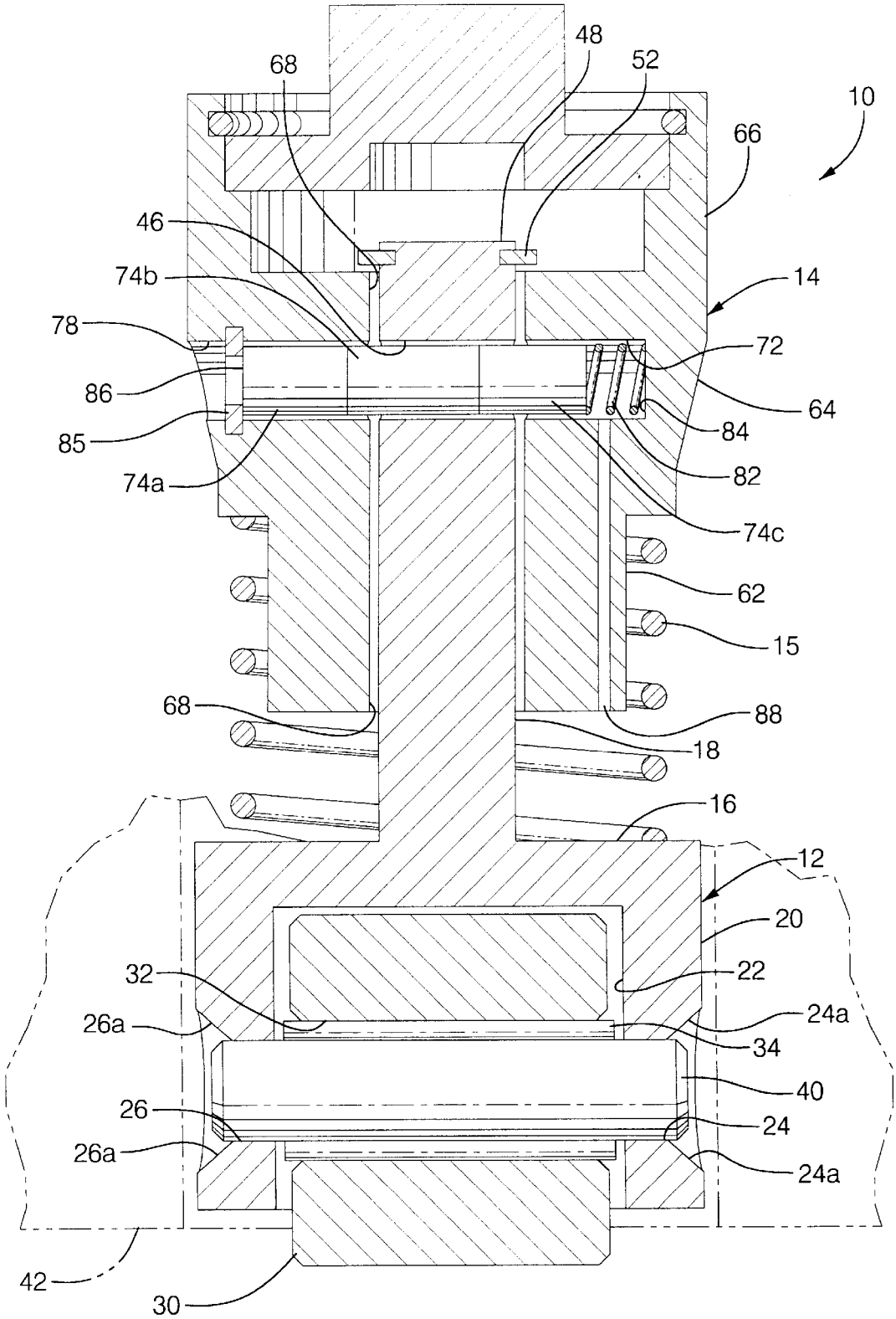
FIG. 1 is an axial cross-sectional view of one embodiment of the split body deactivation valve lifter of the present invention.

Referring now to the drawings and particularly to FIG. 1, there is shown one embodiment of a split body deactivation valve lifter (SBDVL) 10 of the present invention. SBDVL 10 includes lower body 12, upper body 14, and lost motion spring 15.

Lower body 12 includes base portion 16 and elongate column 18. Lower body 12 is preferably constructed of, for example, hardened or hardenable steel. Lower body 12 is substantially cylindrical and has a diameter of, for example, 0.842 inches to thereby be received within a standard-sized lifter bore. However, it is to be understood that lower body 12 can be configured to have a larger or smaller diameter thereby enabling SBDVL to be used in variously-sized lifter bores in internal combustion engines.

Base portion 16 preferably has a substantially cylindrical side wall 20 and defines roller chamber 22. Shaft orifices 24 and 26 are diametrically opposed on side wall 20, each extending through side wall 20 and terminating within roller chamber 22. Each of shaft orifices 24 and 26 include respective chamfer portions 24*a* and 26*a*. Roller 30 is received within roller chamber 22 of base portion 16. Roller 30 is substantially cylindrical and defines shaft bore 32 therethrough. Shaft 40 passes through shaft bore 32, having a first end disposed within shaft orifice 24 and a second end disposed within shaft orifice 26. Shaft 40 is affixed to lower body 12 by, for example, staking. A set of needle bearings 34 is disposed within shaft bore 32 intermediate shaft 40 and roller 30. Roller 30 rides on the cam (not shown) of internal combustion engine 42. Roller 30 is configured to translate rotary motion of the cam to vertical motion of lower body 12. Elongate column 18 of lower body 12 extends in an axial direction a predetermined distance from base portion 16. Elongate column 18 is substantially cylindrical and defines a cylindrical pin bore 46 therethrough. Ring clip 52 is disposed proximate to end 48.

Upper body 14 includes narrowed sleeve portion 62 interconnected by an axially tapered intermediate portion 64 with top portion 66. Each of sleeve portion 62, intermediate portion 64 and top portion 66 are substantially cylindrical. Top portion 66 has a predetermined diameter which is somewhat greater than the diameter of narrowed sleeve portion 62. Intermediate portion 64 tapers in an axial direction from a wider diameter proximate to top portion 66 to a narrower diameter proximate to sleeve portion 62. Upper body 14 defines an axial column bore 68 therethrough and a radial deactivation chamber 72 therein. A portion of elongate column 18 of lower body 12 is slidingly disposed within column bore 68 such that pin bore 46 of elongate column 18 is disposed in radial and axial alignment with deactivation chamber 72. Deactivation pins 74*a*, 74*b*, and 74*c* are associated with upper body 14 as described in more detail hereinafter. Upper body 14 is constructed of, for example, hardened or hardenable steel.

Column bore 68 is substantially cylindrical and extends in an axial direction concentrically through upper body 14. A portion of elongate column 18 is slidingly disposed within and extends through column bore 68 such that end 48 of elongate column 18 extends a predetermined distance from within column bore 68. Ring clip 52 prevents end 48 of elongate column 18 from entering column bore 68, and thereby limits axial movement of upper body 14 away from lower body 12.

Deactivation chamber 72 preferably has substantially cylindrical cross-section and extends a predetermined distance in a radial direction through upper body 14. More particularly, deactivation chamber 72 begins proximate the outside surface of intermediate portion 64 of upper body 14 and extends radially inward, intersecting column bore 68, and ends a predetermined distance beyond column bore 68. Control port 78 is defined by intermediate portion 64 and is in fluid communication with deactivation chamber 72.

Deactivation pins 74*a*, 74*b*, and 74*c* are slidingly disposed within deactivation chamber 72. Compression spring 82 is disposed intermediate inner side wall 84 of deactivation chamber 72 and deactivation pin 74*c*. Compression spring 82 acts to normally bias deactivation pin 74*c* and, in turn, deactivation pins 74*b* and 74*a* in a direction away from inner side wall 84 of deactivation chamber 72. C-clip 85 is disposed within deactivation chamber 72, and acts as a stop to prevent further radial biasing of deactivation pins 74*a*, 74*b*, 74*c* and establishes a default position for the deactivation pins 74*a*, 74*b*, 74*c*. In the default or normal operating position, spring 82 biases at least a portion of pin 74*c* into pin bore 46 of elongate column 18, which is in axial and radial alignment with deactivation chamber 72. Pin 74*b* is preferably dimensioned to have a length substantially equal to the length of pin bore 46 of elongate column 18. Thus, the biasing by spring 82 of a portion of pin 74*c* into pin bore 46 results in the biasing of a corresponding portion of pin 74*b* out of pin bore 46. Pin 74*a* is biased against C-clip 85. Lower body 12 is thereby coupled to upper body 14, and reciprocal motion of lower body 12 is transferred to upper body 14 by deactivation pins 74*b* and 74*c*. Each of pins 74*a*, 74*b* and 74*c* are substantially cylindrical, and are constructed of, for example, hardened or hardenable steel. Compression spring 82 is constructed of, for example, piano wire or any other material appropriate to bias pins 74*a*, 75*b* and 74*c*.

Control port 78 is in fluid communication with deactivation chamber 72, and thus provides a fluid passage through upper body 14 and into deactivation chamber 72. Pressurized fluid, such as, for example, oil is selectively supplied to control port 78 into deactivation chamber 72 in order to overcome the biasing force exerted by compression spring 82 upon deactivation pins 72*a*, 72*b*, and 72*c*. The pressurized fluid acts on face 86 of deactivation pin 74*a* and, in turn, deactivation pin 74*b*, to displace in a radial direction deactivation pin 74*c* from within pin bore 46, thereby disposing deactivation pin 74*b* entirely within pin bore 46 of elongate column 18. Thus, lower body 12 is decoupled from upper body 14, and reciprocal motion of lower body 12 is not transferred to upper body 14. Most preferably, face 86 of pin 74*a* is a substantially flat surface.

Lost motion spring 15 is disposed intermediate lower body 12 and upper body 14, and has a first end associated with lower body 12 and a second end associated with upper body 14. Lost motion spring 15 is a compression spring and acts to bias upper body 14 and lower body 12 axially apart from each other. When lower body 12 is not coupled by deactivation pins 74*b* and 74*c* to upper body 14, reciprocal motion of lower body 12 compresses lost motion spring 15. The spring rate of lost motion spring 15 is selected to be a predetermined amount less than the spring rate of the valve spring (not shown). Thus, the compression of lost motion spring 15 does not exert upon upper body 14 a force of sufficient magnitude to compress the valve spring and open the valve (not shown). Thus, the reciprocal motion of lower body 12 is absorbed by lost motion spring 15, and the corresponding engine valve is not opened. Lost motion spring 15, by exerting an axial force upon lower body 12 ensures roller 30 maintains contact with the cam (not shown) of internal combustion engine 42.

In use, roller 30 is associated with and rides on a lobe (not shown) of a cam shaft (not shown) of an internal combustion engine 42 in a conventional manner. Shaft 40 extends through shaft bore 32 in roller 30 and is attached within shaft orifices 24 and 26, such as, for example, by staking, to lower body 12. As the engine cam rotates, roller 30 follows the profile of an associated cam lobe and shaft 40 translates the rotary motion of the cam lobe to linear, or vertical, motion of lower body 12. When deactivation pins 74*a*, 74*b* and 74*c* are in their default or normal operating position, spring 82 biases each of deactivation pins 74*a*, 74*b*, 74*c* away from inner side wall 84 of deactivation pin chamber 72. Spring 82 biases a portion of deactivation pin 74*c* into pin bore 46 of elongate column 18 which, in turn, biases a portion of deactivation pin 74*b* out of pin bore 46, thereby coupling lower body 12 to upper body 14 for reciprocal vertical movement.

With deactivation pins 74*a*, 74*b*, 74*c* in their default positions, vertical movement of lower body 12 is transferred to upper body 14. Thus, SBDVL 10 vertically reciprocates as one body. The use of at least two deactivation pins 74*b* and 74*c* in transferring the vertical motion balances the forces when lower body 12 is coupled to upper body 14 and SBDVL 10 undergoes vertical reciprocation. Thus, torque upon and bending moments or stresses in SBDVL 10 are reduced. Furthermore, the use of at least two deactivation pins results in a substantially rigid, strong, and durable assembly which can be used at higher engine speeds, or at higher engine revolutions per minute, than an assembly having a single pin. Through valve train linkage (not shown) the reciprocal motion of SBDVL 10 is coupled to and actuates a corresponding intake or exhaust valve (not shown) of internal combustion engine 42.

Deactivation pins 74*b* and 74*c* are moved out of the default position and placed into a deactivated state by the injection of a pressurized fluid, such as, for example oil or hydraulic fluid, through control port 78. The injection of the pressurized fluid is selectively controlled by, for example, a control valve (not shown), solenoid (not shown) or other suitable flow control device. The pressurized fluid is injected through control port 78 and into deactivation chamber 72 at a pressure of from about 15 psi to about 50 psi, most preferably about 28 psi or greater. The pressurized fluid fills the portion of deactivation chamber 72 disposed between control port 78 and face 86 of deactivation pin 74*a*. The pressure forces deactivation pin 74*a* radially which, in turn, displaces deactivation pin 74*b* toward inner side wall 84 of deactivation chamber 72. The displacement of deactivation pin 74*b*, in turn, displaces deactivation pin 74*c* toward inner side wall 84 of deactivation chamber 72 and compresses spring 82. The length of pin members 74*a*, 74*b*, and 74*c* are chosen in conjunction with the spring constant of spring 82 such that, when the pressurized fluid is injected into deactivation chamber 72, deactivation pin 74*b* is displaced entirely into and disposed entirely within pin bore 46 of elongate column 18. The portion of deactivation pin 74*c* which was disposed within pin bore 46 is displaced therefrom by deactivation pin 74*b*. Thus, lower body 12 is decoupled from upper body 14, and vertical reciprocation of lower body 12 is not transferred to upper body 14.

Close tolerances are preferably maintained between deactivation chamber 72 and the diameter of pin members 74*a*, 74*b*, 74*c* to thereby increase and maintain the pressure of the injected pressurized fluid against pin member 74*a*. However, some of the pressurized fluid will penetrate into and through deactivation chamber 72 to points between and beyond deactivation pins 74*a*, 74*b*, 74*c*. Vent and drain passage 88 is defined by upper body 14 and is in fluid communication with deactivation chamber 72, such that any fluid that is disposed between pin member 74*c* and side wall 84 of deactivation chamber 72 will be pushed out by the displacement of pin members 74*a*, 74*b*, 74*c* toward side wall 84 by fluid under relatively high pressure. Further, a predetermined amount of leak down is designed into split body deactivation lifter 10. This leak down occurs in upper body 14, between elongate column 18 and column bore 68, thereby lubricating the interface therebetween.

In the decoupled configuration, vertical reciprocation of lower body 12 results in elongate column 18 slidingly reciprocating within column bore 68. Lost motion spring 15 is alternately compressed and expanded due to vertical reciprocation of lower body 12. As lost motion spring 15 is compressed by the movement of lower body 12 toward upper body 14, lost motion spring 15 exerts an axially-directed force on upper body 14. The spring rate of lost motion spring 15 is selected to be a predetermined amount less than the spring rate of the corresponding valve spring (not shown) of internal combustion engine 42. Thus, compression of lost motion spring 15 requires a force of a lesser magnitude than does compression of the valve spring required to open the valve. As lost motion spring 15 is compressed, the higher spring rate of the valve spring counteracts the force exerted upon upper body 14 by lost motion spring 15, thereby preventing the vertical movement of upper body 14 and preventing the associated valve from opening. Thus, the motion of lower body 12 is absorbed by lost motion spring 15.

Lost motion spring 15 expands as roller 30 follows the return of the cam lobe to its lowest lift profile. The expansion of lost motion spring 15 ensures that roller 30 is maintained in contact with the cam lobe, thereby reducing any excessive clearance or lash between the roller and the cam lobe and minimizing any excessive wear and tear as a result of any such excessive lash. Excessive lash can result in undesirable noise, or lifter clatter, and reduces valve lift and lift duration, all of which contribute to poor and inefficient engine performance. Excessive lash also accelerates wear of a lifter by creating a large gap between the roller and cam lobe. As the cam lobe rotates, it impacts the roller with a sudden and large magnitude force as a result of the large gap between the roller and cam lobe. The sudden and large magnitude impact between the two components significantly increases wear and tear of those components, and may cause premature lifter or valve train failure.

Figure 2:
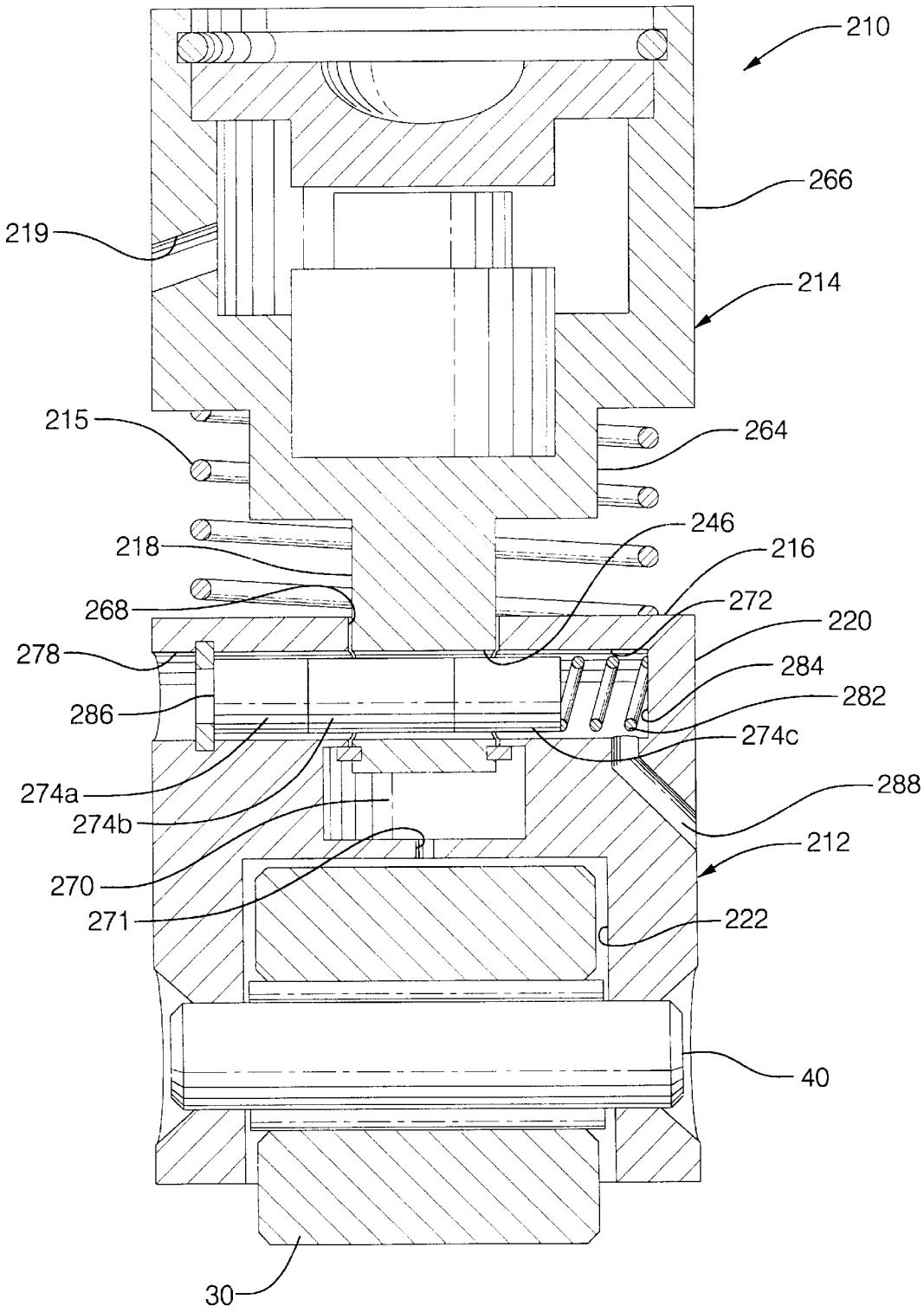
FIG. 2 is an axial cross-sectional view of a second embodiment of the split body deactivation valve lifter of the present invention.

A second embodiment of the split body deactivation valve lifter of the present invention is shown in FIG. 2. SBDVL 210 is a hydraulic deactivation split body valve lifter, and includes lower body 212, upper body 214, and lost motion spring 215.

Lower body 212 includes base portion 216 having a substantially cylindrical side wall 220 and defines roller chamber 222. Roller 30 and shaft 40 are received within roller chamber 222 and attached to base portion 216 as described above in regard to SBDVL 10. Roller 30 is configured to translate rotary motion of the cam to vertical motion of lower body 212. Lower body 212 further defines column bore 268, lost motion chamber 270, and deactivation chamber 272 having side wall 284.

Column bore 268 extends axially from the top surface of base portion 216, into and through deactivation chamber 272, intersecting with and terminating in lost motion chamber 270. Column bore 268 is substantially concentric with lower body 212. Deactivation chamber 272 extends in a radial direction a predetermined distance through a portion of base 216. More particularly, deactivation chamber 272 begins proximate the outside surface of base 216, extends inward intersecting with column bore 268, and extends radially a predetermined distance beyond column bore 268 terminating at inner side wall 284. Control port 278 is defined by base 216 and is in fluid communication with deactivation chamber 272. Deactivation pins 274*a*, 274*b*, 274*c* are slidingly disposed within deactivation chamber 272. Compression spring 282 normally biases deactivation pin 274*c* and, in turn, deactivation pins 274*b* and 274*a* in a radial direction away from inner side wall 284 of deactivation chamber 272.

Upper body 214 includes elongate column 218, intermediate portion 264 and top portion 266. Each of elongate column 218, intermediate portion 264 and top portion 266 are substantially cylindrical. Elongate column 218 extends a predetermined distance in an axial direction from intermediate portion 264. Elongate column 218 defines a cylindrical pin bore 246 radially therethrough. A portion of elongate column 218 of upper body 214 is slidingly disposed within column bore 268 such that pin bore 246 of elongate column 218 is disposed in radial and axial alignment with deactivation chamber 272. Upper body 214 further defines a feed port 219 through which fluid, such as, for example, oil, is injected into SBDVL 210 as is known in conventional hydraulic valve lifters. Upper body 214 is constructed of, for example, hardened or hardenable steel.

Deactivation pins 274*a,* 274*b,* and 274*c* are slidingly disposed within deactivation chamber 272. Compression spring 282 is disposed intermediate inner side wall 284 of deactivation chamber 272 and deactivation pin 274*c*. Compression spring 282 acts to normally bias deactivation pin 274*c* and, in turn, deactivation pins 274*b* and 274*a* in a radial direction away from inner side wall 284. In a default or normal operating position, spring 282 biases at least a portion of pin 274*c* into pin bore 246 of elongate column 218, which is in axial and radial alignment with deactivation chamber 272. Deactivation pin 272*b* is dimensioned to have a length substantially equal to the length of pin bore 246 of elongate column 218. Thus, the biasing by spring 282 of a portion of pin 274*c* into pin bore 246 results in the displacement of a corresponding portion of deactivation pin 274*b* out of pin bore 246 and into deactivation chamber 272. Lower body 212 is thereby coupled to upper body 214. Reciprocal motion of lower body 212 is transferred to upper body 214 by deactivation pins 274*b* and 274*c*. Each of pins 274*a,* 274*b,* 274*c* are substantially cylindrical, and are constructed of, for example, hardened or hardenable steel.

Control port 278 is in fluid communication with deactivation chamber 272, and thus provides a fluid passageway through lower body 212 and into deactivation chamber 272. Pressurized fluid, such as, for example, oil is injected through control port 278 and into deactivation chamber 272 in order to overcome the biasing force exerted by compression spring 282 upon deactivation pins 272*a,* 272*b,* 272*c*. The pressurized fluid acts to displace deactivation pins 272*a,* 272*b,* 272*c,* substantially as described above in regard to control port 78 of SBDVL 10, to decouple lower body 212 from upper body 214. Thus, lower body 212 is decoupled from upper body 214, and reciprocal motion of lower body 212 is not transferred to upper body 214. Preferably, face 286 of deactivation pin 274*a* has a substantially flat surface.

Close tolerances are maintained between deactivation chamber 272 and the diameter of pin members 274*a,* 274*b,* 274*c* to thereby increase the pressure of the injected pressurized fluid against pin member 274*a*. However, some of the pressurized fluid will penetrate into and through deactivation chamber 272 to points between and beyond deactivation pins 274*a,* 274*b,* 274*c*. Vent and drain passage 288 is defined by lower body 212 and is in fluid communication with deactivation chamber 272, such that any fluid that is disposed between pin member 274*c* and side wall 284 of deactivation chamber 272 will be pushed out by the displacement of pin members 274*a,* 274*b,* 274*c* toward side wall 284 by fluid under relatively high pressure. Vent and drain passage 288 opens at one end into the floor or bottom side of deactivation chamber 272 and is oriented such that reciprocation of SBDVL 210 will facilitate and enhance entrance of fluid into and draining of fluid out of vent and drain passage 288. Further, a predetermined amount of leak down is designed into split body deactivation lifter 210. This leak down occurs in lower body 212, between elongate column 218 and column bore 268. The leak down flows through lost motion chamber 270 and out drain and vent hole 271.

Lost motion spring 215 is disposed intermediate lower body 212 and 214 and performs the function as described above in regard to SBDVL 10. Lost motion spring 215 is selected to have a spring constant a predetermined amount less than the spring constant of the corresponding valve spring (not shown) of internal combustion engine 42. Further, the spring constant of lost motion spring 215 is selected to be of sufficient magnitude to resist any pump down due to hydraulic pressure acting on upper body 214. Generally, pump up or pump down occurs in a conventional hydraulic lifter when hydraulic pressure within the lifter is not sufficient to overcome the force of the spring of the valve associated with the lifter, but is sufficient to cause internal expansion of the hydraulic element of the lifter relative to the lifter body. Selecting lost motion spring 215 to have a spring constant of sufficient magnitude enables the lost motion spring to resist the pressures within the hydraulic chamber and prevent pump down. Yet, the spring constant of lost motion spring 215 must be small enough to be compressed by the action of the cam lobe upon roller 30 while SBDVL 210 is in the deactivated or decoupled state.

In the embodiments shown, deactivation pins 72*a,* 72*b,* 72*c,* and 274*a,* 274*b,* 274*c* pin bores 46 and 246 and deactivation chambers 72 and 272 are preferably each substantially cylindrical in cross section. It is to be understood that in the present invention each of deactivation pins, pin bore and deactivation chamber can be alternately configured, such as, for example, as having an oval, rectangular, square, or other cross section geometry and still achieve the objects of the present invention.

While the present invention has been described in terms of a preferred embodiment, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A split-body deactivation valve lifter, comprising:

a lower body including a base and an column extending in an axial direction a predetermined distance from said base, said base configured for being associated with a cam and for converting motion of the cam to motion of said lower body;

a upper body defining an axial column bore therein, a portion of said elongate column of said lower body being slidably disposed within said column bore, said upper body configured for being associated with a valve; and coupling means normally coupling said upper body to said elongate column of said lower body to thereby transfer movement of said lower body to movement of said upper body, said coupling means being configured for selectively decoupling said upper body from said elongate column of said lower body such that movement of said lower body is not transferred to movement of said upper body.

2. The split-body deactivation valve lifter of claim 1, wherein:

said elongate column of said lower body defines a radial pin bore;

said upper body defines a radial deactivation chamber therein; and said coupling means comprises at least one deactivation pin movably carried by said upper body, a first portion of said at least one deactivation pin being normally disposed within said radial pin bore of said elongate column, a second portion of said at least one deactivation pin being normally disposed within said radial deactivation chamber to thereby couple said upper body to said elongate column of said lower body.

3. The split-body deactivation valve lifter of claim 2, wherein said upper body defines a control port therein, said control port being in fluid communication with said deactivation chamber, said control port being configured for having a pressurized fluid injected therethrough and into said deactivation chamber to displace said at least one deactivation pin to be completely located within said pin bore of said elongate and thereby decouple said upper body from said elongate column of said lower body.

4. The split-body deactivation valve lifter of claim 2, wherein said upper body defines a drain passage, said drain passage being in fluid communication with said deactivation chamber.

5. The split-body deactivation valve lifter of claim 2, further comprising biasing means biasing said first portion of said at least one deactivation pin into said radial pin bore of said elongate column, thereby normally coupling said upper body to said elongate column of said lower body.

6. The split-body deactivation valve lifter of claim 5, wherein said biasing means comprises a compression spring disposed within said deactivation chamber and exerting a radially-directed force upon said at least one deactivation pin.

7. The split-body deactivation valve lifter of claim 1, further comprising a lost motion spring disposed intermediate said lower body and said upper body, said lost motion spring having a first end and a second end, said first end being associated with said lower body, said second end being associated with said upper body.

8. The split-body deactivation valve lifter of claim 7, wherein said lost motion spring is a coil spring, said coil spring having a first spring constant, said first spring constant being greater than a second spring constant of a valve spring of the associated valve.

9. A split-body deactivation valve lifter for use in an internal combustion engine, said split-body deactivation valve lifter comprising:

a lower body having a substantially cylindrical wall interconnected with a top, an elongate column integral with said top and extending in an axial direction a predetermined distance from said top, said elongate column defining a pin bore therethrough, said lower body configured for converting rotary motion of a cam of the engine to linear motion of said lower lifter body;

a substantially cylindrical upper body defining a column bore and a deactivation chamber, said column bore extending axially through at least a portion of said upper body, said deactivation chamber extending radially outward from said column bore and through at least a portion of said upper body, at least a portion of said elongate column being slidably disposed within said column bore such that said pin bore is normally disposed in axial and radial alignment with said deactivation chamber, said upper body being associated with a valve of is the internal combustion engine;

a deactivation pin assembly disposed partially within said column bore and partially within said deactivation chamber, said deactivation pin assembly normally coupling said elongate column to said upper body to thereby transmit vertical movement of said lower body to vertical movement of said upper body when said deactivation pin assembly is in a default position, said deactivation pin assembly configured for being radially displaced from said default position into a decoupled position to thereby decouple said elongate column from said upper body.

10. The split-body deactivation valve lifter of claim 9, wherein said deactivation pin assembly comprises a first outside pin member, a middle pin member, and a second outside pin member, said middle pin member being disposed intermediate said first outside pin member and said second outside pin member, said deactivation pin assembly disposed in said default position when said first outside pin member is disposed entirely within said deactivation chamber, said middle pin member has a first portion disposed within said deactivation chamber and a second portion disposed within said pin bore of said elongate column, said second outside pin member has a first portion disposed within said deactivation chamber and a second portion disposed within said pin bore of said elongate column, said middle pin member and said second outside pin member thereby coupling said elongate column to said upper body to transmit movement of said lower body to movement of said upper body when said deactivation pin assembly is in said default position, said deactivation pin assembly configured for being radially displaced from said default position into a decoupled position wherein said middle pin member is disposed entirely within said pin bore of said elongate column and said first and said second outside pin members are disposed entirely outside of said pin bore of said elongate column to thereby decouple said elongate column from said upper body.

11. The split-body deactivation valve lifter of claim 10, wherein each of said deactivation chamber, said first outside pin member, said middle pin member, said second outside pin member, and said pin bore are substantially cylindrical.

12. The split-body deactivation valve lifter of claim 10, wherein each of said deactivation chamber, said first outside pin member, said middle pin member, said second outside pin member, and said pin bore are substantially rectangular.

13. The split-body deactivation valve lifter of claim 10, wherein said deactivation chamber includes an inner end wall, said second outside pin member being disposed proximate said inner end wall;

a compression spring disposed between said second outside pin member and said inner end wall, said compression spring biasing said deactivation pin assembly away from said inner end wall and into said default position.

14. The split-body deactivation valve lifter of claim 13, further comprising a C-clip disposed at least partially within said deactivation chamber proximate to said first outside pin member, said C-clip and said first outside pin member in abutting engagement when said deactivation pin assembly is in said default position, said compression spring radially biasing said deactivation pin assembly until said first outside pin member contacts said C-clip.

15. The split-body deactivation valve lifter of claim 9, wherein said upper body defines a control port, said control port in fluid communication with said deactivation chamber, said control port configured for having a flow of pressurized fluid injected therethrough and into said deactivation chamber, the pressurized fluid radially displacing said deactivation pin assembly from said default position and into said decoupled position.

16. The split-body deactivation valve lifter of claim 9, further comprising a lost motion spring disposed intermediate said lower body and said upper body, said lost motion spring having a first end and a second end, said first end associated with said lower body, said second end associated with said upper body.

17. The split-body deactivation valve lifter of claim 16, wherein said lost motion spring has a first spring constant, which is less than a second said spring constant of a valve spring of the associated valve of the internal combustion engine.

18. The split-body deactivation valve lifter of claim 17, wherein said lost motion spring comprises a coil spring.

19. The split-body deactivation valve lifter of claim 9, further comprising a roller disposed within a roller chamber, defined by said lower body.

20. A method of deactivating a cylinder of an internal combustion engine, said method comprising the steps of:

providing a lower valve lifter body configured for engaging a cam shaft of the engine, said lower valve lifter body configured for converting rotary motion of the cam to linear motion of said lower valve lifter body;

supplying an upper valve lifter body, said upper valve lifter body configured for being associated with a valve of the internal combustion engine, said upper valve lifter body configured for actuating through linear motion the associated valve;

normally coupling said lower valve lifter body to said upper valve lifter body to thereby transmit vertical motion of said lower valve lifter body to vertical motion of said upper valve lifter body; and selectively decoupling said lower valve lifter body from said upper valve lifter body such that the motion of said lower valve lifter body is not transmitted to said upper valve lifter body.

21. The method of claim 20, wherein said lower valve lifter body includes an elongate column, said upper valve lifter body defines a column bore at least partially therethrough, at least a portion of said elongate column being slidably disposed within said column bore, said normally coupling step comprising the step of coupling said elongate column to said upper valve lifter body.

22. The method of claim 21, wherein said normally coupling step further comprises coupling within said column bore said elongate column to said upper valve lifter body.

23. The method of claim 21, wherein said upper valve lifter body defines a radial deactivation chamber extending in a radial direction from said column bore, said elongate column defining a pin bore therethrough, said coupling step further comprising the step of disposing a deactivation pin assembly partially within said deactivation chamber and partially within said column bore.

24. The method of claim 22, wherein said deactivation pin assembly comprises a first outside pin member, a middle pin member, and a second outside pin member, said middle pin member being disposed intermediate said first outside pin member and said second outside pin member, wherein said coupling step further comprises the steps of normally locating said first outside pin member entirely within said deactivation chamber;

normally locating a first portion of said middle pin member being within said deactivation chamber and a second portion of said middle pin member within said pin bore;

and normally locating a first portion of said second outside pin member within said pin bore and a second portion of said second outside pin member within said deactivation chamber.

25. The method of claim 23, wherein said selectively decoupling step comprises the step of communicating into said deactivation chamber a pressurized fluid, said pressurized fluid pushing on said deactivation pin assembly to displace said first portion of said middle pin member from within said deactivation chamber and into said pin bore, thereby displacing said first portion of said second outside pin member from within said pin bore and into said deactivation chamber.

26. The method of claim 20, further comprising the step of absorbing the motion of said lower valve lifter body with a lost motion spring when said lower valve lifter body is decoupled from said upper valve lifter body, said lost motion spring being disposed intermediate said lower valve lifter body and said upper valve lifter body.

27. The method of claim 25, further comprising the step of selecting said lost motion spring to have a first spring constant, less than a second spring constant of a valve spring of the associated valve of the internal combustion engine.

* * * * *